United States Patent [19]

Hwang

[11] Patent Number: 4,861,970

[45] Date of Patent: Aug. 29, 1989

[54] MULTIPURPOSE CALCULATOR

[76] Inventor: Kuo H. Hwang, 115, Kuo Tze Lih, Pei Twen District, Taichung, Taiwan

[21] Appl. No.: 297,973

[22] Filed: Jan. 17, 1989

[51] Int. Cl.[4] ..... G06C 5/02

[52] U.S. Cl. ..... 235/10; 235/1 R; 235/61 A; 364/708

[58] Field of Search ..... 235/1 R, 1 D, 61 A, 235/86; 364/708

[56] References Cited

U.S. PATENT DOCUMENTS

| | | | |
|---|---|---|---|
| 2,642,225 | 6/1953 | Lee | 235/86 |
| 4,075,702 | 2/1978 | Davies | 364/708 X |
| 4,404,643 | 9/1983 | Ojima et al. | 364/708 X |
| 4,596,923 | 6/1986 | Kuo | 235/1 D |
| 4,736,332 | 4/1988 | Crease | 364/708 |

*Primary Examiner*—B. R. Fuller

*Attorney, Agent, or Firm*—Pacific Asian Patent and Trademark Office

[57] ABSTRACT

A multipurpose calculator includes a casing having one pair of side slots made at the front on both side walls for pivotally movable connection thereto of a movable cassette block, said movable cassette block being applicable to move within 180°, four elongated holes made on the front end wall through the body of the casing for setting therein of a scraper, a fluorescent marker, a flat type screw driver, and a cross type screw driver respectively. The movable cassette block comprises an illuminating apparatus to provide a solar power calculator with sufficient energy for operation. The said casing includes a rectangular recess for setting thereon of a solar calculator, a cutter and a steel tape respectively mounted on both sides for specific application. According to above-described arrangement, a calculator is practical for multipurpose application.

1 Claim, 7 Drawing Sheets

MULTIPURPOSE CALCULATOR

BACKGROUND OF THE INVENTION

The present invention is to provide a multipurpose calculator equipped with steel tape, cutter, illuminating apparatus, fluorescent marker, screw driver, and scraper.

Regular solar power operated calculators are exclusively designed for calculation, without having any supplementary illuminating apparatus. Conventional calculators with self-provided illuminating apparatus are relatively heavy, not convenient to carry. Further, few calculators of regular portable type are designed to carry with any self-provided illuminating apparatus.

SUMMARY OF THE INVENTION

The present invention is related to a multipurpose calculator with self-provided steel tape, cutter, illuminating apparatus, fluorescent marker, driver, and scraper, and more particularly to a calculator adapted for multipurpose application. According to the present invention, a multipurpose calculator is comprised of a casing, a solar calculator, and a movable cassette block. Said casing includes two side slots respectively arranged at the front end on both side walls for pivotal connection thereto and of said movable cassette block for form a complete working box. There is provided a rectangular recess made on the top surface of said casing for setting thereon of a solar calculator. Said casing also comprises a cutter and a steel tape respectively arranged on both lateral sides. There are four elongated holes made on the front end wall of through the body of said casing for receiving scraper, fluorescent marker, flat type screw driver and cross type screw driver respectively. The movable cassette block comprises thereinside an illuminating apparatus to provide sufficient illumination and to provide the solar calculator with sufficient energy for operation.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

According to the present invention, a multipurpose calculator is comprised of a casing, a movable cassette block, an illuminating apparatus, a cutter, a pusher plate, a steel tape, one set of tools, and a clip.

Figure 1:
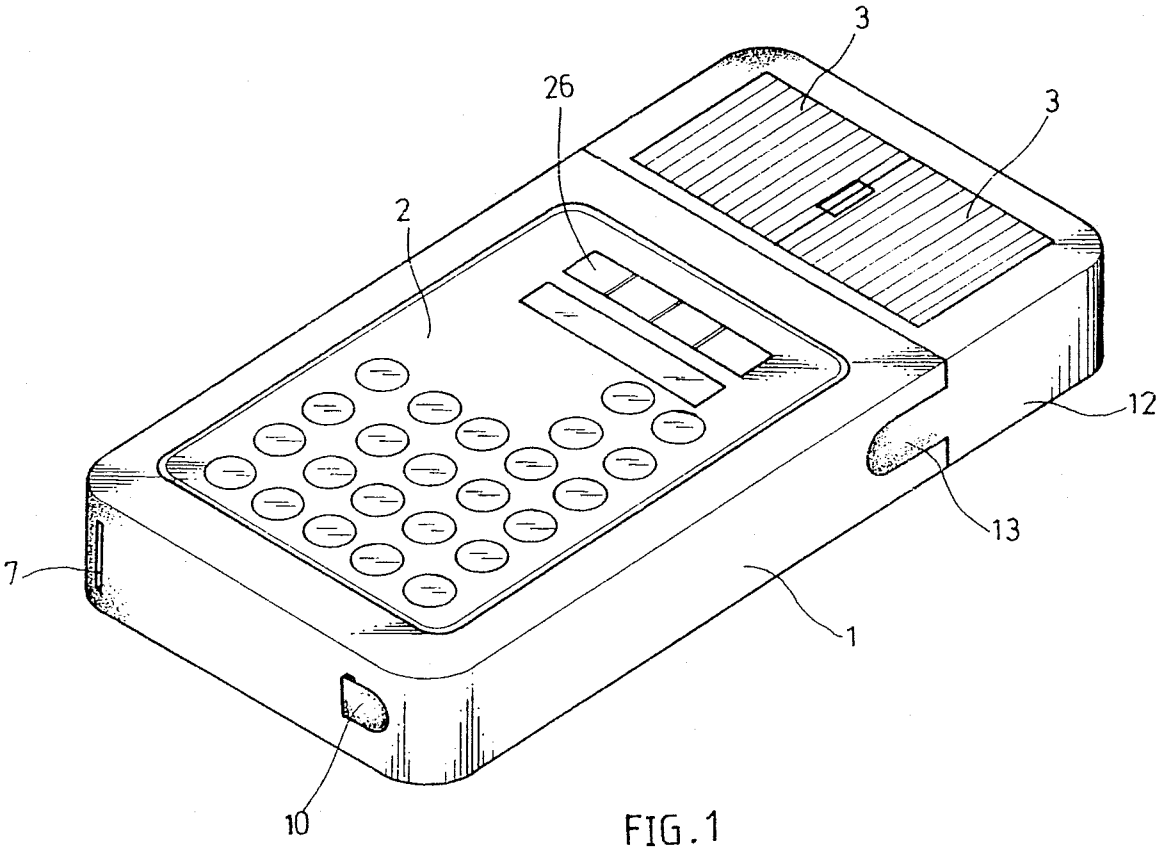
FIG. 1 is a perspective view of a multipurpose calculator constructed according to the present invention.
Figure 2:
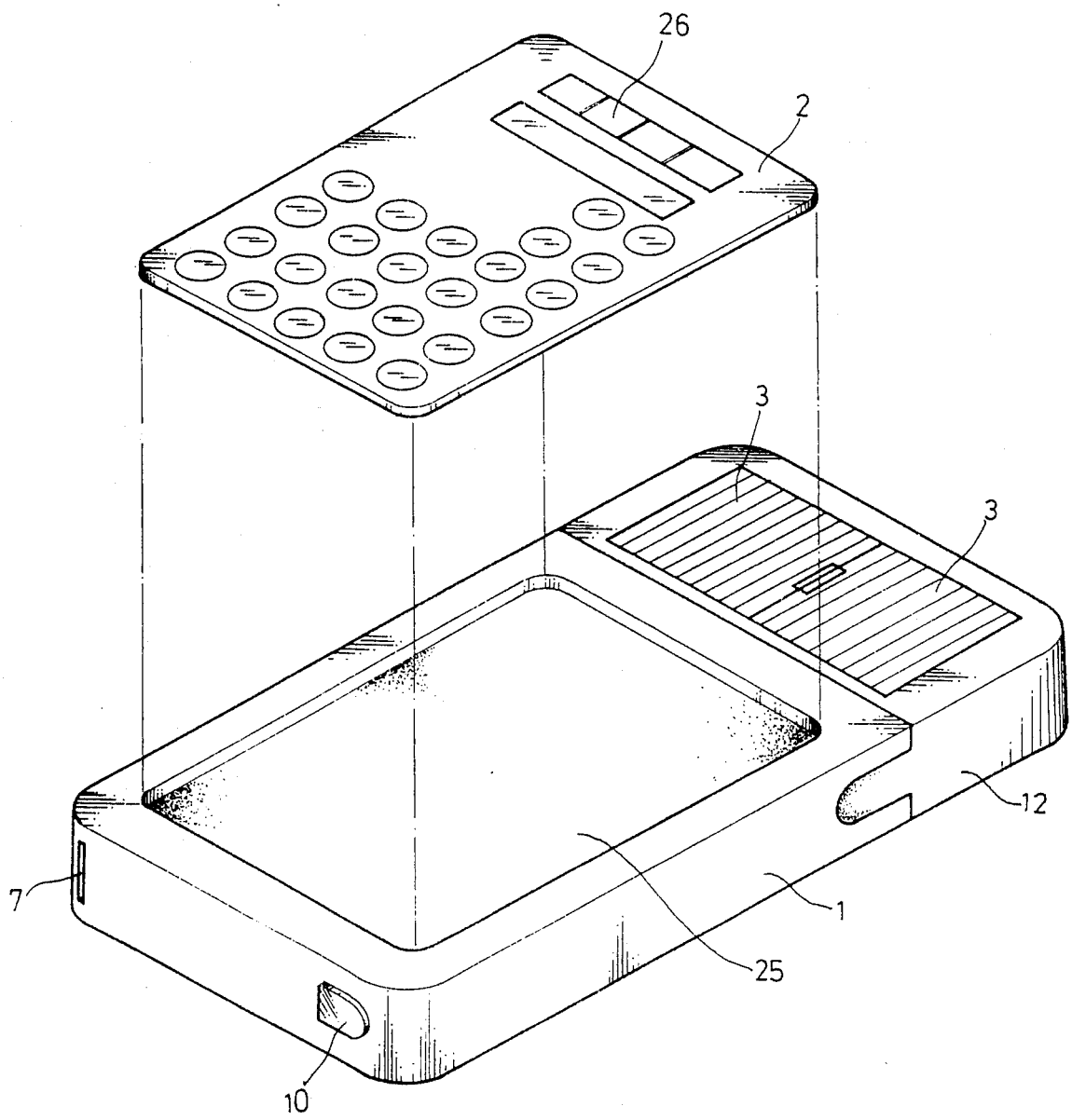
FIG. 2 shows an expanded perspective view of the preferred embodiment of FIG. 1.

FIG. 1 illustrates the outer appearance of a multipurpose calculator constructed according to the present invenion. As shown in FIG. 1, the casing 1 includes one pair of slots 14 bilaterally disposed at upper end, for respectively setting therein of the two linking rods 13 of a movable cassette block 12, such that said movable cassette block 12 is flexibly attached to the casing 1 for making pivotal movement within an angle of 180°. Said movable cassette block 12 includes a double swinging-doors-switch 3. Said double swinging-doors-switch 3 may be drawn backward to support said movable cassette block 12 when said movable cassette block 12 is slantly disposed. Said movable cassette block 12 also includes thereinside an illuminating apparatus comprised of dry battery cells 11, bulbs 16, and mirror 15, wherein said battery cells 11 is controlled by said swinging-doors-switch 3 to turn on said bulbs 16 to illuminate. The illumination provided by said bulbs 16 is reflected by said mirror 15 onto the solar energy collector 26 of a calculator disposed on said casing 1 such that said solar power operated calculator is functioning efficiently and free from interference of outer lighting condition.

Figure 3:
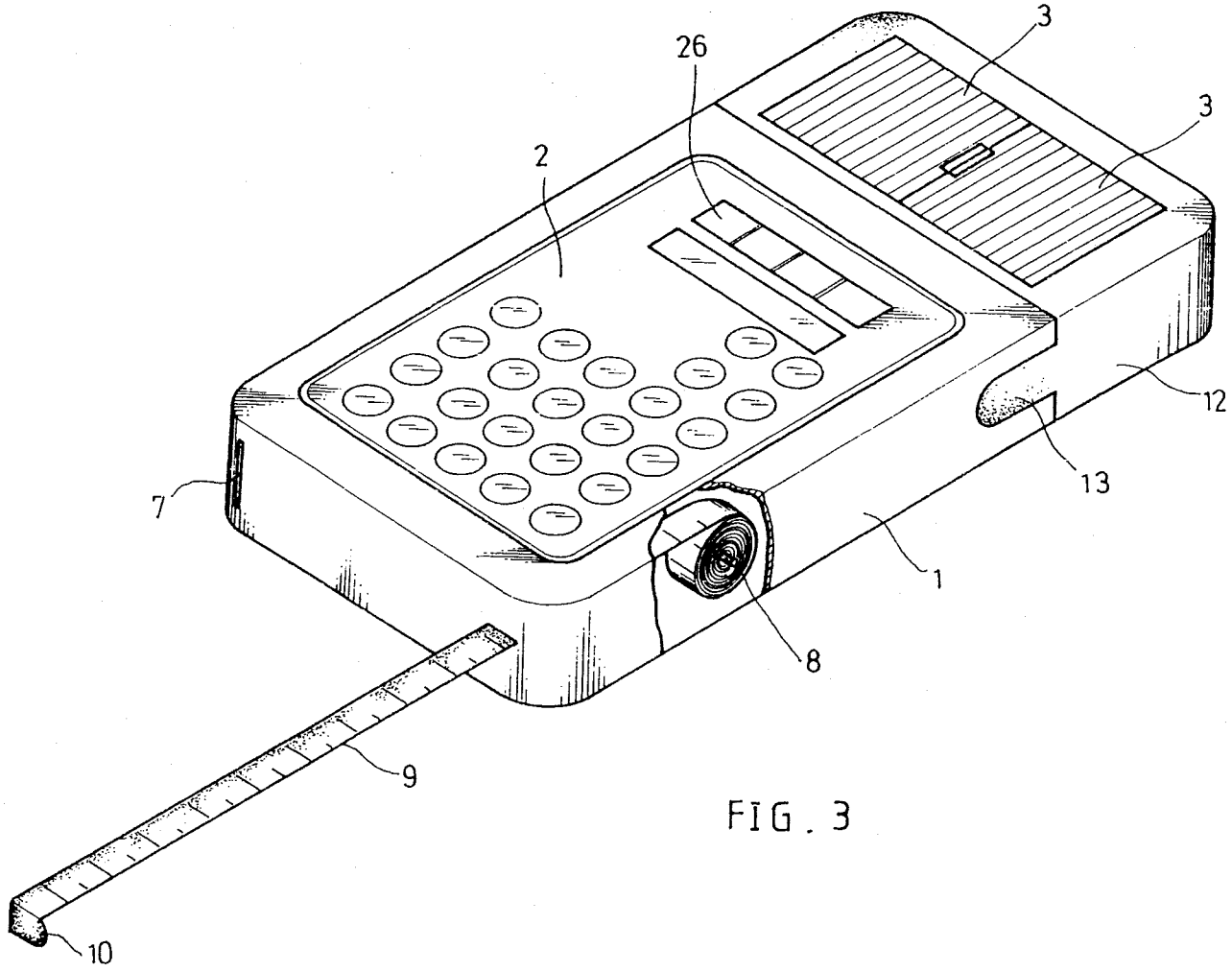
FIG. 3 is a perspective view of the said preferred embodiment, illustrating the arrangement of a steel tape.

Referring to FIG. 3, there is provided a steel tape 9 winding round a post 8 arranged in said casing 1 on the right side. The operation of said steel tape 9 is similar to regular measuring tape. When it is used in dark place, the said illuminating apparatus may be operated to provide illumination to help the application.

Figure 4:
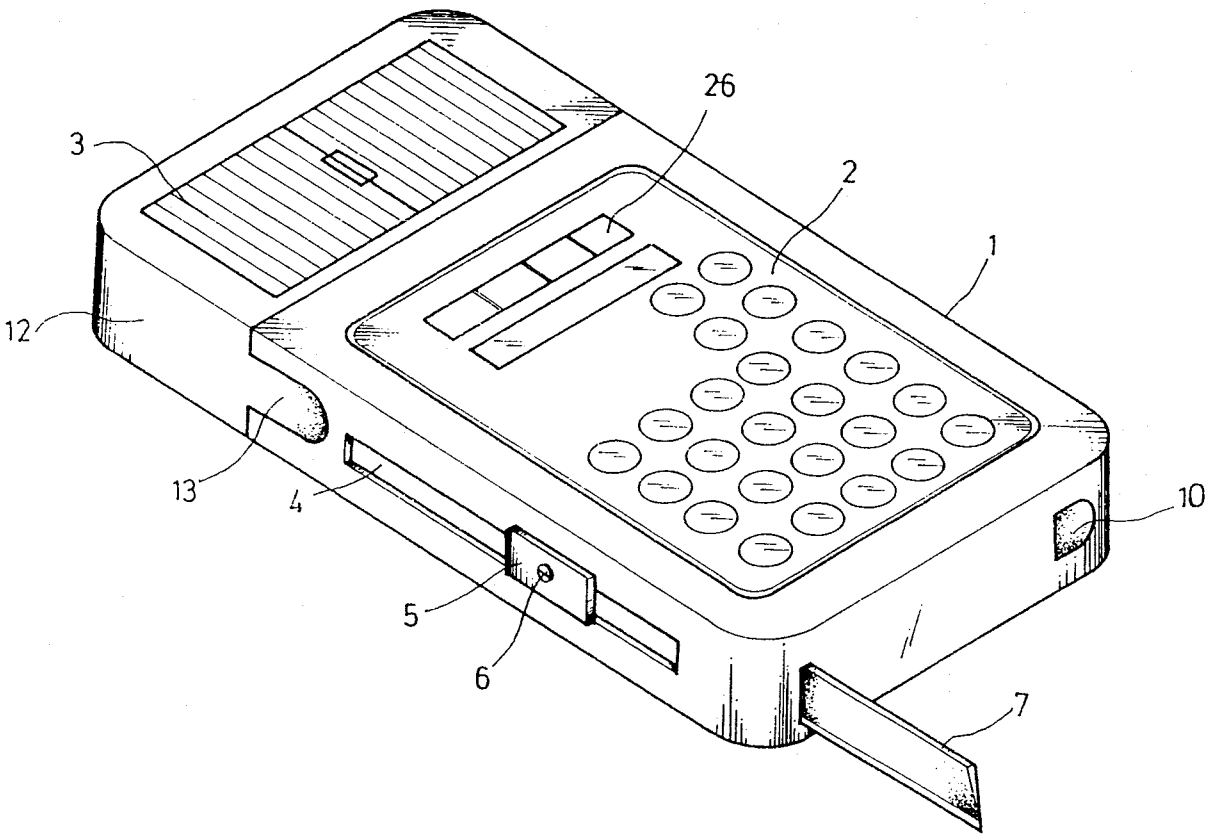
FIG. 4 is a perspective view of the said preferred embodiment, illustrating the arrangement of a cutter.
Figure 5:
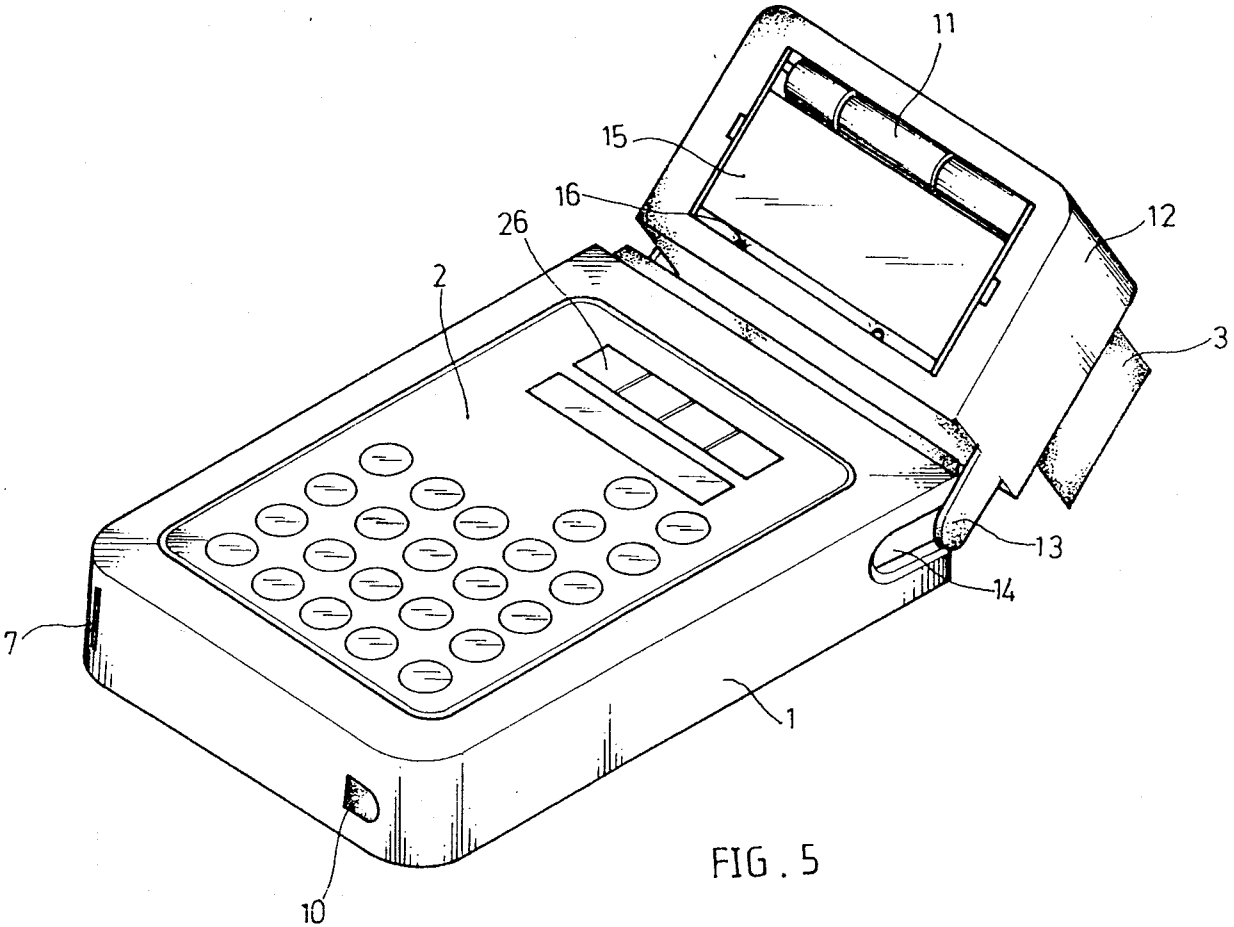
FIG. 5 is a perspective view of the said preferred embodiment, illustrating the arrangement of an illuminating apparatus.

Referring to FIG. 4, there is provided a cutter in said casing 1 arranged on the left side, along the elongated slide slot 4, wherein a pusher plate 5 is connected with a cutting blade 7 by a screw 6 to control the sliding of the cutter. By means of said arrangement, a calculator is designed to provide a snap-off cutter.

Figure 6:
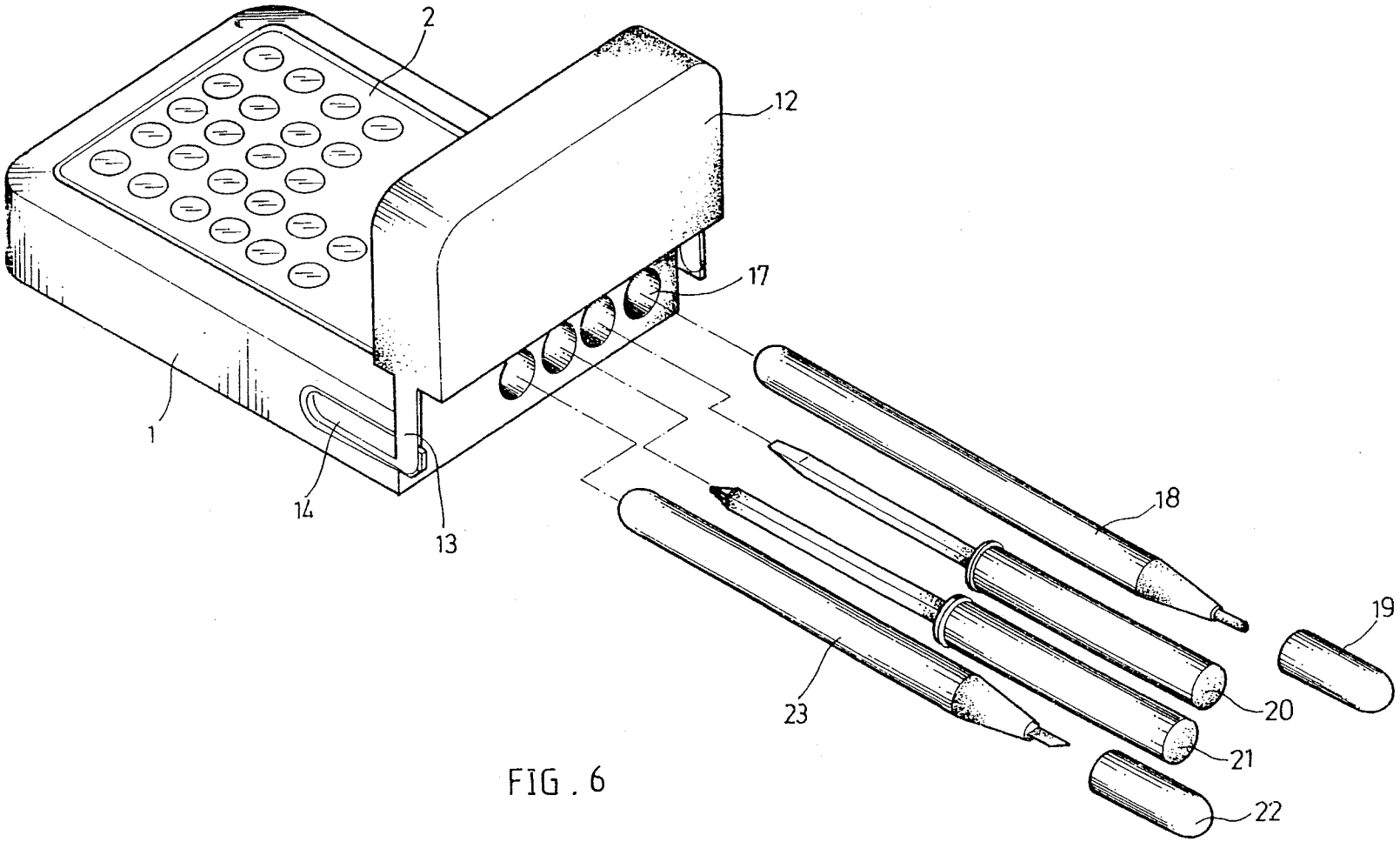
FIG. 6 is a perspective view of the said preferred embodiment, illustrating the arrangement of engineering tools.

Referring to FIG. 6, when said cassette block 12 is lifted to a vertical position, four elongated holes 17 are presented on the end wall of said casing 1. Said four elongated holes 17 are arranged for setting therein of a scraper 23, a fluorescent marker 18, a flat type screw driver 20, and a cross type screw driver 21 respectively. By means of said arrangement, a calculator is designed to provide one set of tools for multipurpose application.

Figure 7:
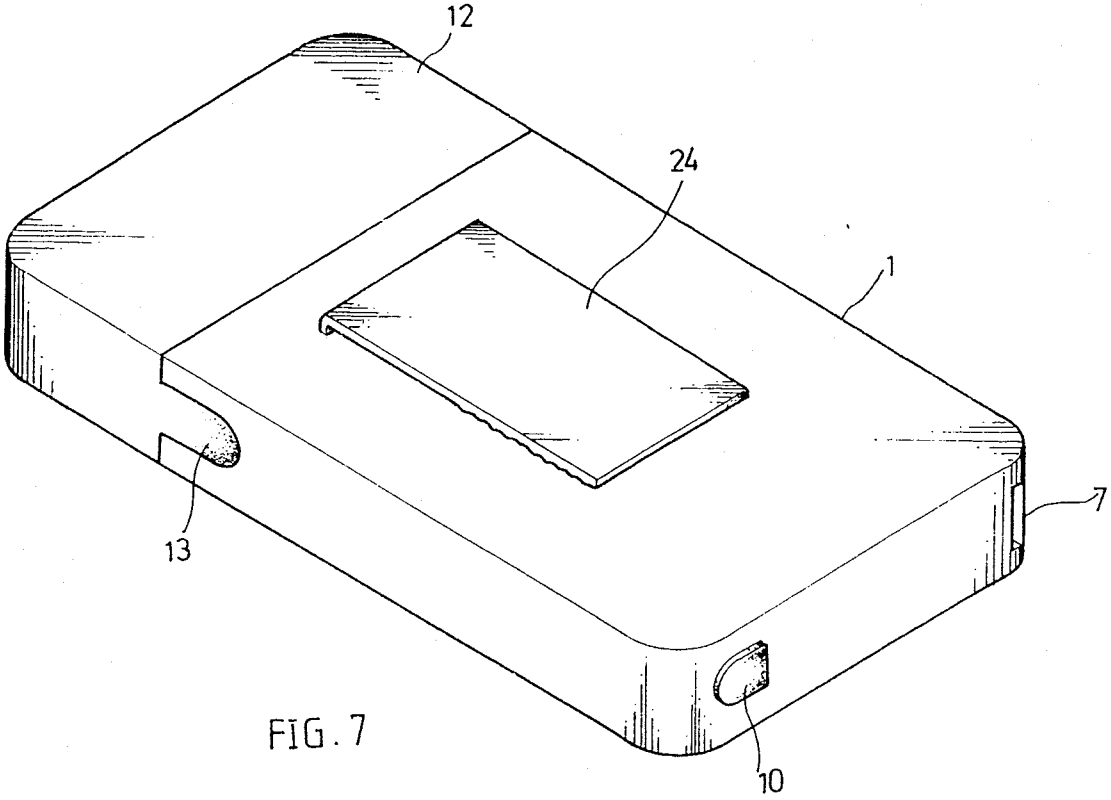
FIG. 7 is a perspective back side view of the said preferred embodiment, illustrating the arrangement of a resilient clip.

Referring to FIG. 7, there is provided a resilient clip 24 on the back side of the said casing 1, such that the whole assembly of the apparatus may be attached to one's belt for ready use.

As indicated, the structure herein may be variously embodied. Recognizing various modifications will be apparent, the scope hereof shall be deemed to be defined by the claims as set forth below.

I claim:

1. A multipurpose calculator, including:

a casing body, having one pair of side slots respectively made in right and left side walls of said casing body at a front end wall thereof for pivotally movable connection thereto of a movable cassette block, a steel tape provided within said casing body near the right side wall, a snap-off cutter set within said casing body adjacent the left side wall, and four elongated holes made in the front end wall extending through the body of the casing for respectively setting therein screw drivers, a fluorescent marker and scraper, opening and closing of said elongated holes being controlled by said movable cassette block;

said movable cassette block, being movably attached to said casing by means of one pair of linking rods through pivotal connection;

an elongated slide slot made in the left sidewall of said casing for sliding therealong a pusher plate;

said snap-off cutter being connected to and moved by the pusher plate to slide along said elongated slide slot;

the pusher plate, being connected to a rear end of said cutter to move said cutter so as to slide along said elongated slide slot;

said steel tape, being wind around a post arranged in said casing on the right side;

an illuminating apparatus comprised of dry battery cells, bulbs, and mirror, said battery cells being operated to turn on said bulbs to illuminate, the illumination provided by said bulbs being reflected by said mirror onto a solar energy collector of said calculator disposed on said casing;

a movable swinging-doors-switch, being mounted on said movable cassette block to protect said mirror, said dry battery cells and said bulbs, and to control turning-on/off of said bulbs;

said fluorescent marker, being set in any one of said four elongated holes of said casing;

said screw drivers, being set in any other said number of elongated holes of said casing;

said scraper, being set in any remaining one of said elongated holes of said casing; and a resilient clip, being mounted on a back side of said casing, to let said multipurpose calculator be attached to an apparel of a user.

* * * * *